US010060424B2

(12) United States Patent
Fujiwara et al.

(10) Patent No.: US 10,060,424 B2
(45) Date of Patent: Aug. 28, 2018

(54) FLUID SENDING APPARATUS

(75) Inventors: Susumu Fujiwara, Tokyo (JP); Naho Misumi, Tokyo (JP); Shiro Takeuchi, Tokyo (JP); Junichiro Hoshizaki, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 502 days.

(21) Appl. No.: 14/116,175

(22) PCT Filed: Jun. 20, 2011

(86) PCT No.: PCT/JP2011/003498
§ 371 (c)(1),
(2), (4) Date: Nov. 7, 2013

(87) PCT Pub. No.: WO2012/176228
PCT Pub. Date: Dec. 27, 2012

(65) Prior Publication Data

US 2014/0147308 A1 May 29, 2014

(51) Int. Cl.
*F04B 43/04* (2006.01)
*F04B 35/04* (2006.01)
(Continued)

(52) U.S. Cl.
CPC ..... *F04B 43/04* (2013.01); *F04B 17/04* (2013.01); *F04B 17/042* (2013.01); *F04B 35/04* (2013.01); *F04B 35/045* (2013.01); *F04B 49/06* (2013.01)

(58) Field of Classification Search
CPC ..... F04B 43/04; F04B 17/042; F04B 35/045; F04B 17/04; F04B 49/06; F04B 35/04
(Continued)

(56) References Cited

U.S. PATENT DOCUMENTS 4,163,876 A * 8/1979 Ohnuki ..... H04R 7/04 181/170
5,371,806 A * 12/1994 Kohara ..... H04R 9/025 381/420
(Continued)

FOREIGN PATENT DOCUMENTS

JP 3675203 B2 7/2005
JP 2007-237803 A 9/2007
(Continued)

OTHER PUBLICATIONS

Translation of WIPO publication WO01/71190 A1, Krause et al. , "Oscillating Armature Diaphragm Pump", Sep. 27, 2001.*
(Continued)

*Primary Examiner* — Charles Freay
*Assistant Examiner* — Lilya Pekarskaya
(74) *Attorney, Agent, or Firm* — Posz Law Group, PLC

(57) ABSTRACT

A fluid sending apparatus includes a signal generator that generates a signal including a signal component that has a one-sided waveform and is composed of a rising component in a positive voltage direction, a falling component in the positive voltage direction, and a vortex ring formation time component T, and a damping component for driving for a predetermined time with a voltage less than or equal to one-half of a voltage in the positive voltage direction, the waveform of each of the signal component and the damping component corresponding to a single wave.

8 Claims, 7 Drawing Sheets

(51) Int. Cl.
*F04B 49/06* (2006.01)
*F04B 17/04* (2006.01)

(58) Field of Classification Search
USPC ..... 239/102.1, 102.2
See application file for complete search history.

(56) References Cited

U.S. PATENT DOCUMENTS 6,711,269 B2 * 3/2004 Kobayashi ..... H04R 9/00 381/117
7,433,487 B2 * 10/2008 Shimamura ..... H04R 9/025 381/412
7,682,137 B2 * 3/2010 Nakayama ..... H01L 23/467 310/317
2003/0021427 A1 * 1/2003 Nakada ..... H04R 3/002 381/96
2007/0261438 A1 * 11/2007 Ezaka ..... A61L 9/015 62/643

FOREIGN PATENT DOCUMENTS

JP 4613859 B2 1/2011
JP 2011-094870 A 5/2011
WO 01/71190 A1 9/2001
WO WO01/71190 * 9/2001

OTHER PUBLICATIONS

Office Action dated Jan. 19, 2016 issued in corresponding CN patent application No. 201180071734.3 (and English translation).
Office Action dated Jan. 13, 2015 issued in corresponding JP patent application No. 2013-5212911.
Chinese Office Action dated Jun. 3, 2015 in the corresponding CN application No. 201180071734.3 ( English translation attached ).
Office Action dated Jul. 1, 2014 issued in corresponding JP patent application No. 2013-521291 (and English translation).
International Search Report of the International Searching Authority dated Sep. 20, 2011 for the corresponding international application No. PCT/JP2011/003498 (and English translation).
Extended European Search Report dated Oct. 29, 2015 in the corresponding EP application No. 11868375.4.
Office Action dated Mar. 28, 2017 issued in corresponding EP patent application No. 11 868 375.4.
Office Action dated Jun. 14, 2016 in the corresponding CN patent application No. 201180071734.3 (with English translation).

* cited by examiner

FLUID SENDING APPARATUS

CROSS REFERENCE TO RELATED APPLICATION

This application is a U.S. national stage application of International Application No. PCT/JP2011/003498 filed on Jun. 20, 2011.

TECHNICAL FIELD

The present invention relates to a fluid sending apparatus for sending fluid (for example, a gas-phase, a liquid phase having a very small diameter, or an oily material) in lump form to any area (for example, an indoor space or an outdoor space), and in particular, relates to a fluid sending apparatus equipped with a driving mechanism for sending fluid and a signal generator for driving the driving mechanism.

BACKGROUND ART

There have been fluid sending means (e.g., vortex ring sending apparatuses and air guns) for emitting fluid to any area. Such means include well-known means for applying forced vibration to a molded box to send to a remote area a gas phase obtained with smoke or the like from an opening in the molded box. In such means using forced vibration, forced vibration to be applied to the molded box is achieved by an operation of "hitting" a structure that forms the molded box, the operation being performed mainly by a human.

As regards other means having the same advantages, there are a case where a fan is used for sending and a case where an existing direct drive loudspeaker (speaker) for acoustic radiation intended to radiate an acoustic signal is used (refer to Patent Literature 1, for example). Furthermore, in another case, a solenoid that performs piston oscillation similar to operation of a speaker is used as sending means (the solenoid being configured such that a wire is wound like a coil around a side surface of a cylindrical hollow member and a magnet is disposed in the axis of the cylindrical hollow member) (refer to Patent Literature 2, for example).

CITATION LIST

Patent Literature

Patent Literature 1: Japanese Unexamined Patent Application Publication No. 2007-237803 (FIG. 3)

Patent Literature 2: Japanese Patent No. 3675203 (FIG. 24)

SUMMARY OF INVENTION

Technical Problem

In the means for sending fluid using an existing acoustic radiation speaker, vibrations of a diaphragm, a diaphragm support member, or the like constituting the speaker or the form of an input signal affects the diaphragm or the diaphragm support member, thus causing their unnecessary vibrations. Additionally, it takes a long time to attenuate the unnecessary vibrations of the diaphragm or the diaphragm support member. Disadvantageously, sending a constant amount of fluid therefore cannot be achieved. Furthermore, the fluid may be sent in a direction different from an intended direction. Accordingly, the diaphragm or the diaphragm support member generates noise (hereinafter, referred to as "abnormal noise") unnecessary for sending. Unfortunately, this causes discomfort in use.

To send fluid to a remote area, the diaphragm has to be vibrated with large amplitude. When the diaphragm is vibrated with large amplitude, unnecessary vibrations of the diaphragm and the support material for the diaphragm tend to occur. Disadvantageously, an intended amount of fluid cannot be sent in a correct direction. In addition, since the configuration is not dedicated for sending means, such a configuration affects the cost. The same disadvantages may arise in the case where the solenoid is used as sending means.

Furthermore, according to the techniques disclosed in Patent Literature 1 and Patent Literature 2, fluid cannot be sent in different directions at the same time or with a time lag. Unfortunately, a single lump of fluid can be sent in a relatively limited direction.

The present invention has been made to overcome the above-described disadvantages and provides a fluid sending apparatus capable of reliably sending a proper amount of fluid in a determined direction without causing abnormal noise.

Solution to Problem

The invention provides a fluid sending apparatus including at least one driving mechanism that includes a diaphragm to apply sending force to fluid, the driving mechanism vibrating the diaphragm, and a signal generator that generates a signal to vibrate the diaphragm and transmits the signal to the driving mechanism. The signal generator forms the signal such that the signal includes a signal component having a one-sided waveform and being composed of a rising component in a positive voltage direction, a falling component in the positive voltage direction, and formation time existing between the rising component and the falling component, the waveform of the signal component corresponding to a single wave, and a negative voltage damping component for driving for a predetermined time with a voltage that is less than or equal to one-half of a voltage in the positive voltage direction, the damping component having a waveform corresponding to a single wave.

Advantageous Effects of Invention

The fluid sending apparatus according to the invention can reliably send a proper amount of fluid in a determined direction without causing abnormal noise.

DESCRIPTION OF EMBODIMENTS

Embodiments of the invention will be described below with reference to the drawings.

Figure 1:
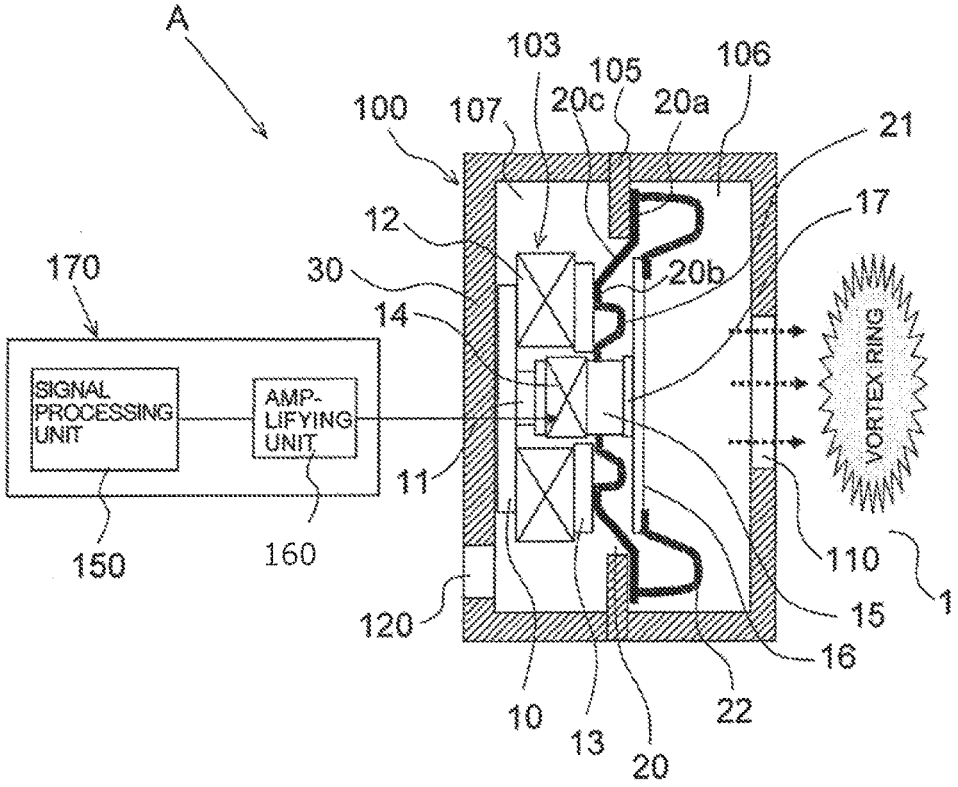
FIG. 1 is a schematic sectional structural diagram illustrating a schematic configuration of a fluid sending apparatus according to Embodiment 1 of the invention.

FIG. 1 is a schematic sectional structural diagram illustrating a schematic configuration of a fluid sending apparatus A according to Embodiment 1 of the invention. The fluid sending apparatus A will be described in detail with reference to FIG. 1. Note that the dimensional relationship among elements in FIG. 1 and the following figures may be different from the actual ones.

The fluid sending apparatus A is configured to send fluid (for example, a gas phase, a liquid phase having a very small diameter, or an oily material) in the form of a lump (vortex ring or ring) to any area (fluid sending space 1 illustrated in FIG. 1), such as an indoor space or an outdoor space. Examples of fluid to be sent include air containing water vapor. The fluid sending apparatus A includes a driving mechanism 100 and a signal generator 170. The driving mechanism 100 includes a vibration force generating unit, a vibrating unit, and a cabinet 30 accommodating these units.

The vibrating unit includes at least a diaphragm 16, a frame 20, a circular damper (second elastic member) 21, and a circular edge (first elastic member) 22. Furthermore, the vibration force generating unit includes at least a yoke 10, a center pole 11, a magnet 12, a plate 13, a voice coil 14, and a voice coil bobbin 15. The voice coil bobbin 15 is connected via an adhesive layer 17 to the diaphragm 16. Furthermore, the vibrating unit and the vibration force generating unit constitute a magnetic circuit 103.

The yoke 10 is a plate-shaped member that serves as a base of the vibration force generating unit. The center pole 11 is a cylindrical member molded at the center of the yoke 10. The magnet 12 is fastened at a given distance from the center pole 11 so as to surround the center pole 11. Specifically, the yoke 10 fixes the center pole 11 and the magnet 12. Although the yoke 10 may have any shape, for example, a circular plate-shaped member may be used. As regards the magnet 12, for example, neodymium, samarium cobalt, ferrite, or alnico is used.

The plate 13 is a plate-shaped member fastened to an upper surface of the magnet 12. The voice coil 14 is configured to input a signal for driving the driving mechanism 100. The voice coil bobbin 15 is a substantially cylindrical hollow member having an outer circumferential surface around which the voice coil 14 is wound. The width of winding of the voice coil 14 (or the area of contact of the voice coil 14 with the voice coil bobbin 15) has such an area to substantially cover the outer circumferential surface of the voice coil bobbin 15. The voice coil bobbin 15, which is attached to the center pole 11, performs electromagnetic driving with the magnet 12 in response to the form of an input signal applied to the voice coil 14 and an input voltage in, so that the whole of the voice coil bobbin 15 vibrates (vibrates laterally in FIG. 1).

The diaphragm 16 is attached via the adhesive layer 17 to an end surface of the voice coil bobbin 15 (opposite from a surface to which the center pole 11 is attached). The diaphragm 16 may have a flat-plate shape, alternatively, a cone shape or dome shape for a typical speaker. Preferably, the diaphragm 16 is a flat-plate-shaped member made of resin, metal, or the like exhibiting high rigidity as means for sending a lump of fluid which will be described later. Furthermore, since fluid in a pressurized space 106 may be steam at a high temperature (at or above 100 degrees C.) or an erosive substance, such as aromatic oil, it is preferable that the diaphragm 16 include a base member made of heat-resistant polypropylene or an ABS material and the base member be covered with a coating made of an erosion-resistant material, such as silica.

The adhesive layer 17 has viscosity to fasten the diaphragm 16 to a fixed position in the voice coil bobbin 15. The frame 20 is a member that is substantially toroidal in plan view. The frame 20 includes a first fixing portion 20*a*, a second fixing portion 20*b*, and a tapered portion 20*c* connecting the first fixing portion 20*a* and the second fixing portion 20*b*. The first fixing portion 20*a* is fixed to a fixing member 105. The second fixing portion 20*b* is fixed to an upper surface of the plate 13. The first fixing portion 20*a*, the second fixing portion 20*b*, and the tapered portion 20*c* constituting the frame 20 may be in one piece or may be separate pieces joined by welding, for example.

The circular damper 21 is substantially toroidal in plan view. A first end of the circular damper 21 is connected to the outer circumferential surface of the voice coil bobbin 15 and a second end thereof is connected to the upper surface of the plate 13. The circular damper 21 is a member curved toward an outlet 11. The circular damper 21 has a function of holding the voice coil bobbin 15 in any position relative to the plate 13 and the frame 20. The circular edge 22 is substantially toroidal in plan view. A first end of the circular edge 22 is connected to an upper surface of the first fixing portion 20*a* of the frame 20 and a second end thereof is connected to an upper surface of the diaphragm 16 at the periphery of the diaphragm 16. The circular edge 22 has a function of holding the diaphragm 16 in any position relative to the frame 20.

To discharge a lump of fluid from a pressurized space (corresponding to the pressurized space 106 which will be described later), strong pressure fluctuations have to be generated within the pressurized space. To ensure a distance necessary for sending and strong pressure fluctuations, the diaphragm has to be vibrated by at least 10 mm within the pressurized space. The above-described facts were experimentally demonstrated. The driving mechanism 100 is therefore configured such that the circular damper 21 and the circular edge 22 each have a radius of 10 mm or more and each of the diaphragm 16 and the voice coil bobbin 15 can vibrate by 10 mm or more relative to its resting state by actions of the circular damper 21 and the circular edge 22.

The circular damper 21 and the circular edge 22 are molded of a material having high elasticity, such as synthetic rubber (e.g., ethylene-propylene-diene rubber (EPDM)). Accordingly, the circular damper 21 and the circular edge 22 have proper elasticity. If the amplitude of vibration of the diaphragm 16 increases, the circular damper 21 and the circular edge 22 are therefore prevented from being broken. Furthermore, the synthetic rubber has high wear resistance. In addition, the synthetic rubber has high erosion resistance (specifically, for example, oil resistance, heat resistance, cold resistance, ozone resistance, weather resistance, acid resistance, and alkali resistance). Accordingly, if the fluid contains an erosive component, erosion can be prevented.

The cabinet 30 is a substantially box-shaped member including a rear space 107 in which the magnetic circuit 103 of the driving mechanism 100 can be placed and the pressurized space 106 for storing the fluid to be sent in the form of a vortex ring, the rear space 107 and the pressurized space 106 being arranged on both sides of the diaphragm 16. Furthermore, the cabinet 30 includes the fixing member 105 such that the fixing member 105 inwardly protrudes from an inner surface of the cabinet 30. The first fixing portion 20*a* of the frame 20 is fixed to an upper surface of the fixing member 105 by any means (such as screws or adhesion). The fixing member 105 may be separate from the cabinet 30 and may be engaged with the inner surface of the cabinet 30 or may be fixed to the inner surface of the cabinet 30 with screws or an adhesive.

The pressurized space 106 is a space defined on the front of the diaphragm 16 (on a side opposite from the side connected to the voice coil bobbin 15) and is configured to store the fluid to be sent in an intended direction. The pressurized space 106 has a predetermined capacity for the amount of fluid to be sent in the form of a vortex ring. In case of diffusion of an erosive fluid, such as aromatic oil, an inner surface of the pressurized space 106 may be coated with an erosion-resistant material, such as silica.

On the other hand, the rear space 107 is a space defined on the rear of the diaphragm 16 (on the side connected to the voice coil bobbin 15) and functions as a receiving space in which the magnetic circuit 103 is placed. Accordingly, the rear space 107 has such a capacity that the magnetic circuit 103 can be disposed. The pressurized space 106 does not communicate with the rear space 107 and there is no ventilation between these spaces. In other words, the pressurized space 106 and the rear space 107 are separated by the fixing member 105 and the frame 20 such that air does not enter from one space to the other space.

The cabinet 30 has the outlet 110 having any diameter through which the pressurized space 106 communicates with the outside of the cabinet 30. A case where the single outlet 110 is disposed in a wall (right wall in the drawing sheet of FIG. 1) of the cabinet 30 opposite the diaphragm 16 is illustrated herein. Any number of outlets 110 may be arranged and the outlet 110 may be disposed in any position. Although the outlet 110 may have any opening shape, the outlet 110 may have the same shape as that of the diaphragm 16 in plan view. For example, the outlet 110 may be circular.

The cabinet 30 further has an opening 120 having any diameter through which the rear space 107 communicates with the outside of the cabinet 30. The opening 120 allows the magnetic circuit 103 to communicate with the outside of the cabinet 30 such that motion of the diaphragm 16 is not suppressed. In other words, the opening 120 functions to allow vibrations transmitted to the rear space 107 of vibrations emitted from the diaphragm 16 to escape from the cabinet 30 to the outside. A case where the opening 120 is placed in a wall in lower part of the drawing sheet of FIG. 1 is illustrated herein. The opening 120 may have any shape. For example, the opening 120 may be circular. Obviously, a vibration absorbing member for absorbing vibrations may be disposed on an inner surface of the rear space 107.

Figure 2:
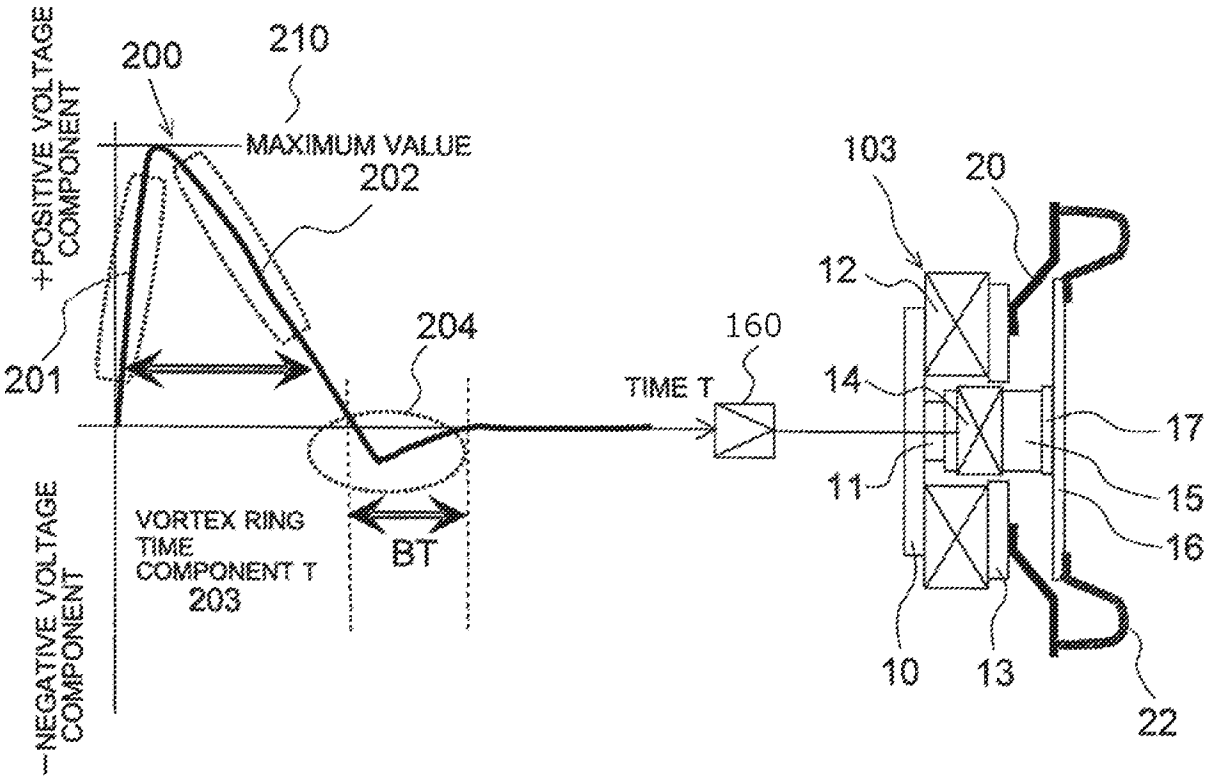
FIG. 2 is a schematic diagram explaining an example of a drive signal to drive a driving mechanism, the signal being generated by a signal generator of the fluid sending apparatus according to Embodiment 1 of the invention.

The signal generator 170 includes at least a drive signal processing unit 150 and an amplifying unit 160. The drive signal processing unit 150 has a function of generating a signal to drive the voice coil 14. The amplifying unit 160 is connected to the output of the drive signal processing unit 150 and has a function of amplifying the signal generated by the drive signal processing unit 150. The drive signal processing unit 150 generates a signal having a waveform as illustrated in FIG. 2 which will be described later. The generated signal is transmitted through the amplifying unit 160 to the voice coil 14. Thus, the magnetic circuit 103 generates magnetic force, which drives the diaphragm 16.

The voice coil 14 is connected through a signal line (not illustrated) to the signal generator 170 and is supplied with current corresponding to a drive signal transmitted from the signal generator 170. Thus, the voice coil 14 acts as an electromagnet and interacts with a magnetic field generated by the magnet 12 to produce force (magnetic force) that causes the voice coil bobbin 15 with the wound voice coil 14 to vibrate. The vibrations are transmitted through the adhesive layer 17 to the diaphragm 16. As described above, in the fluid sending apparatus A, the voice coil 14 allows the voice coil bobbin 15 to vibrate and the diaphragm 16 accordingly vibrates, thus forming a vortex ring.

The vibrations of the voice coil bobbin 15 include various frequency components, in particular, a high frequency component which is not necessary to form a vortex ring. The high frequency component causes mechanical vibrational noise associated with vibrations of the driving mechanism 100.

FIG. 2 is a schematic diagram explaining an example of a drive signal to drive the driving mechanism 100, the signal being generated by the signal generator 170. In FIG. 2, reference numeral 200 denotes a schematic signal waveform, reference numeral 201 denotes a rising component, reference numeral 202 denotes a falling component, reference numeral 203 denotes a vortex ring formation time component T that exists between the rising component 201 and the falling component 202 and contributes to the shape of fluid to be sent, reference numeral 204 denotes a damping component following the falling component, and reference numeral 210 denotes a maximum value of the rising component 201. In cases where the rising component 201 and the falling component 202 constitute a positive voltage component having a one-sided waveform, the damping component 204 is a negative voltage component having a one-sided waveform. The negative voltage is less than or equal to one-half of the positive voltage. The one-sided waveform of each component corresponds to a single wave.

Figure 3:
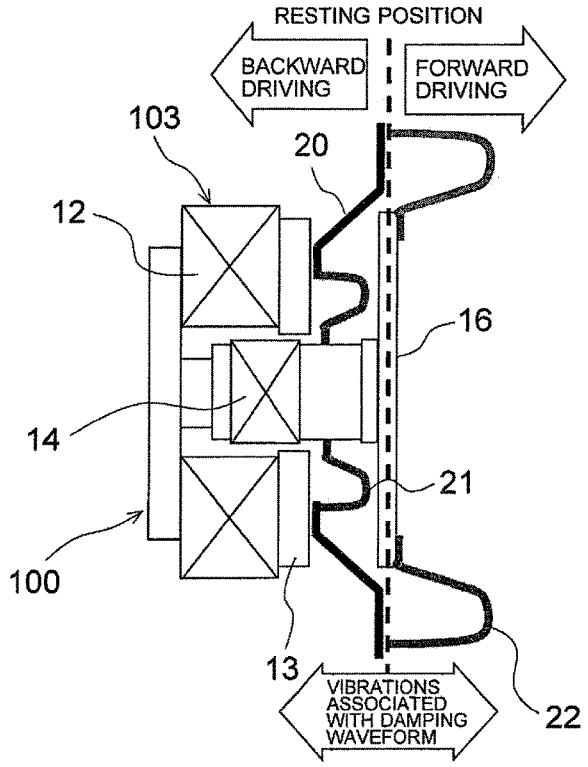
FIG. 3 is a schematic diagram explaining motion of the driving mechanism in accordance with a schematic signal waveform generated by the signal generator.

FIG. 3 is a schematic diagram explaining motion of the driving mechanism 100 in accordance with the schematic signal waveform 200 generated by the signal generator 170. The motion of the driving mechanism 100 will be described with reference to FIGS. 2 and 3.

Referring to FIG. 3, the diaphragm 16 moves from its original state, serving as a non-driven state (resting state, i.e., resting position) in a direction (rightward in the drawing sheet of FIG. 3) away from the magnetic circuit 103 in response to the positive voltage applied. This motion will be referred to as "forward driving" hereinafter. Specifically, the diaphragm 16 is abruptly driven forward in accordance with the rising component 201 for driving time which will be described later. At the maximum value 210, the circular damper 21 and the circular edge 22 can move forward 10 mm or more. The diaphragm 16 is then returned to the resting position in accordance with the damping component 204 for driving time which will be described later.

In the fluid sending apparatus A, therefore, the diaphragm 16 is moved in accordance with the one-sided waveform of the positive component formed by the drive signal processing unit 150, so that the fluid in the pressurized space 106 can be discharged in the form of a lump through the outlet 110 out of the cabinet 30. At this time, the fluid is discharged in the form of a lump that serves as a toroidal vortex (referred to as a "vortex ring") from the outlet 110.

Note that a mechanical vibrational component does not immediately attenuate. The diaphragm 16 therefore performs small vibrations such that "backward driving" corresponding to movement from the resting position toward the magnetic circuit 103 and the above-described "forward driving" are alternately repeated with a very short period. The small vibrations act as negative pressure that allows the vortex ring emitted from the outlet 110 to be returned to the pressurized space 106, thus causing a braking operation for slowing down the vortex ring which is being sent. To prevent such a braking operation, therefore, the fluid sending apparatus A generates the damping component 204 in order to suppress resonant vibrations of the driving mechanism 100 including the diaphragm 16.

The falling component 202 partly affects gradual returning of the diaphragm 16 to the resting position. On the other hand, the damping component 204 has a signal waveform intended to force the diaphragm 16 to be returned to the resting position and attenuate unnecessary resonant vibrations of the entire driving mechanism 100. Accordingly, the waveform of the damping component 204 allows the movement of the diaphragm 16 to be suppressed and further prevents unnecessary braking motion acting on a vortex ring discharged from the outlet 110.

In FIG. 2, reference symbol BT denotes driving time of the damping component 204. The driving time BT is less than or equal to time corresponding to a frequency component (for example, 0.02 seconds corresponding to 50 Hz) at or below an acoustic impedance characteristic Fo when the driving mechanism 100 is disposed in the cabinet 30 (refer to FIG. 4 which will be described later). FO will be described later.

An example of a drive signal will be further described.

In the fluid sending apparatus A, the adhesive layer 17 is disposed between the voice coil bobbin 15 and the diaphragm 16 in the configuration of the driving mechanism 100 in order not to generate abnormal noise (mechanical vibrational noise associated with vibrations of the mechanism) in the driving mechanism 100. The adhesive layer 17 functions as means for preventing vibrations caused by electromagnetic components generated by the voice coil 14 from being transmitted to the diaphragm 16. Thus, mechanical vibrational noise components can be reduced.

Furthermore, in the fluid sending apparatus A, the driving mechanism 100 is driven in accordance with the schematic signal waveform 200 formed by the drive signal processing unit 150 in order to further reduce abnormal noise associated with vibrations of the driving mechanism 100. The schematic signal waveform 200 reduces the dimensions of a vortex ring and damps the diaphragm 16 and further improves driving conditions of the form of a vortex ring.

Figure 4:
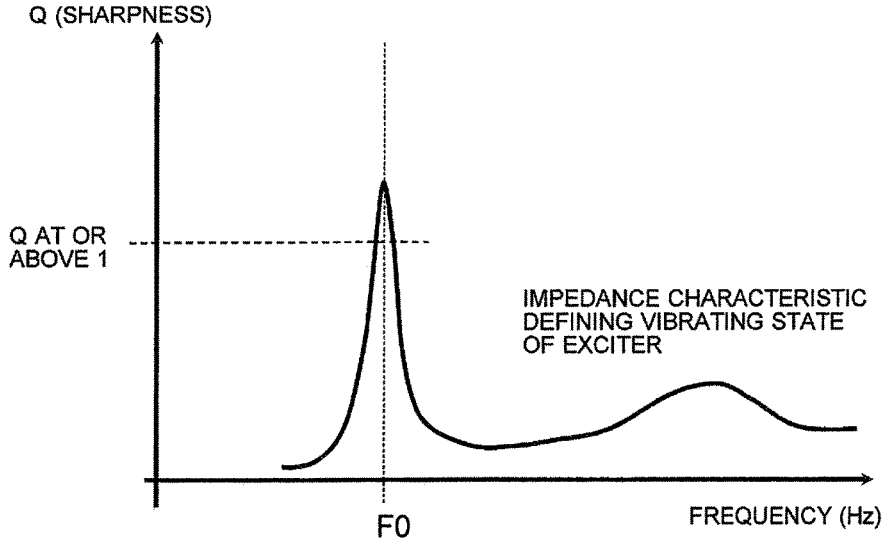
FIG. 4 is a graph illustrating an example of acoustic impedance characteristic measured in a state where the driving mechanism of the fluid sending apparatus according to Embodiment 1 of the invention is mounted in a cabinet.

FIG. 4 is a graph illustrating an example of acoustic impedance characteristic measured in a state where the driving unit and the vibration force generating unit are mounted in the cabinet 30. In FIG. 4, reference symbol F0 (pronounced "ef-zero") corresponds to a frequency at which all of the elements constituting the driving mechanism 100 vibrate simultaneously (resonant state). The resonant state of the driving mechanism 100 can be estimated using the sharpness (Q (pronounced [kju:])) of F0.

The shaper Q is, the shaper the generated resonance of the elements. Resonance time is expressed by resonance time wave Fm. The longer Fm, the longer the resonant state continued. The lower the F0, the harder to hear by the human ear the frequency is. As the frequency of noise is lower, an awareness of the noise as abnormal noise is lower. Furthermore, the shorter Fm, the less discomfort of abnormal noise. In other words, the longer Fm, the longer the discomfort continued. Accordingly, the lower the resonant frequency F0 is and the shorter the resonance time wave Fm is, the effect on the human sense of hearing can be reduced. As long as F0 is sufficiently low, discomfort in the sense of hearing is small if Fm is long to some extent. Furthermore, Q for ideal Fm is greater than or equal to 1.

As described above, it is necessary to control Fo and Fm in the state where the driving unit and the vibration force generating unit are mounted in the cabinet 30. As regards Fo, a low frequency at or below 50 Hz, serving as a power supply frequency, in a frequency band in which discomfort in the sense of hearing is small is used. Although there is no problem if the driving mechanism 100 is originally driven at a low frequency, the driving mechanism 100 may be driven at a frequency above 50 Hz depending on a material for the driving mechanism 100 or the size of the diaphragm 16. In this case, the resonance time wave Fm of the schematic signal waveform 200 generated in the drive signal processing unit 150 may be driven within a low frequency band.

The following (Expression 1) is used to determine driving time (resonance time wave Fm).

$$Fm=1/Hz \qquad \text{(Expression 1)}$$

For example, driving time of 0.02 S is determined at 50 Hz.

A case where driving is performed at 30 Hz irrespective of the dimensions of the diaphragm 16 will be described. When 30 Hz is used, Fm is obtained as 0.03 S using the above-described (Expression 1). It is assumed that time during which the rising component 201 reaches the maximum value 210 is 0.005 seconds. The remaining 0.025 seconds are used as the falling component 202. To efficiently send the fluid in the form of a "vortex ring" through the outlet 110 out of the cabinet, the action of pressure fluctuations within the pressurized space 106 caused by discharge through the small outlet 110 has to be taken into consideration. In order to send the fluid stored in the pressurized space 106 through the small outlet 110 provided in the wide pressurized space 106 against pressure fluctuations such that the fluid is not remained in the pressurized space 106, the fluid has to be sent in consideration of the following points.

Furthermore, in order to reliably send a proper amount of fluid in a determined direction without causing abnormal noise, the following points (a) to (e) have to be taken into consideration:

(a) to apply acceleration to the diaphragm 16 in order to push content (fluid) in the pressurized space 106 out of the space;

(b) to increase the diameter of a vortex ring, that is, to leave no content in the pressurized space 106;

(c) to take plenty of time to return the diaphragm 16 to the resting position;

(d) to damp the diaphragm 16 in order to prevent unnecessary vibrations; and (e) to preferably perform any operation in silence in consideration of preventing discomfort of unnecessary noise and use at night.

To achieve the above-described (a) to (e), the fluid sending apparatus A enables the diaphragm 16 in the driving mechanism 100 to be vibrated widely by the circular edge 22 and the circular damper 21. Furthermore, time of the rising component 201 provides acceleration to the diaphragm 16.

In addition, the vortex ring formation time component T 203 allows content in the pressurized space 106 to be discharged in the form of a thick vortex ring from the pressurized space 106 to the outside of the cabinet 30 without abnormal noise. Additionally, the damping component 204 suppresses unnecessary vibrations of the diaphragm 16 to prevent unnecessary braking action on a vortex ring and further suppresses unnecessary vibrations of the entire driving mechanism 100 to prevent additional braking action.

The vortex ring formation time component T 203 in the waveform illustrated in FIG. 2 has the function of affecting the thickness of a vortex ring and the function of taking measures against abnormal noise. This corresponds to long driving time of the diaphragm 16. For example, when the vortex ring formation time component T is 0.001 S, the frequency is 1000 Hz. Accordingly, time to form a ring is very short and the frequency is in a high frequency band, so that uncomfortable abnormal noise occurs during driving of the driving mechanism. In the fluid sending apparatus A, therefore, the driving mechanism is driven at Fo less than or equal to 50 Hz, thereby achieving measures against abnormal noise and reliable sending of a vortex ring in a determined direction.

Figure 5:
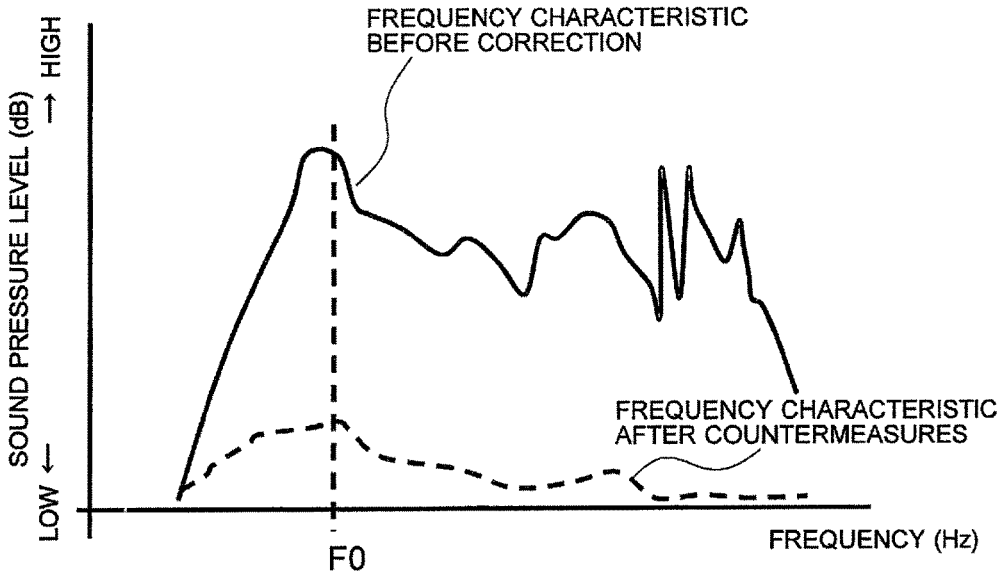
FIG. 5 is a diagram illustrating an example of noise characteristic obtained in sending a vortex ring using the driving mechanism in which measures against noise have been taken.

FIG. 5 illustrates an example of noise characteristic in sending a vortex ring using the driving mechanism 100 with the measures against abnormal noise. The solid line indicates a characteristic obtained before the measures are taken and the broken line indicates the characteristic obtained after the measures are taken. FIG. 5 demonstrates that the sound pressure level of noise in the driving mechanism 100 with the measures against abnormal noise is significantly reduced as compared with that in the characteristic obtained before the measures are taken.

Embodiment 2

Figure 6:
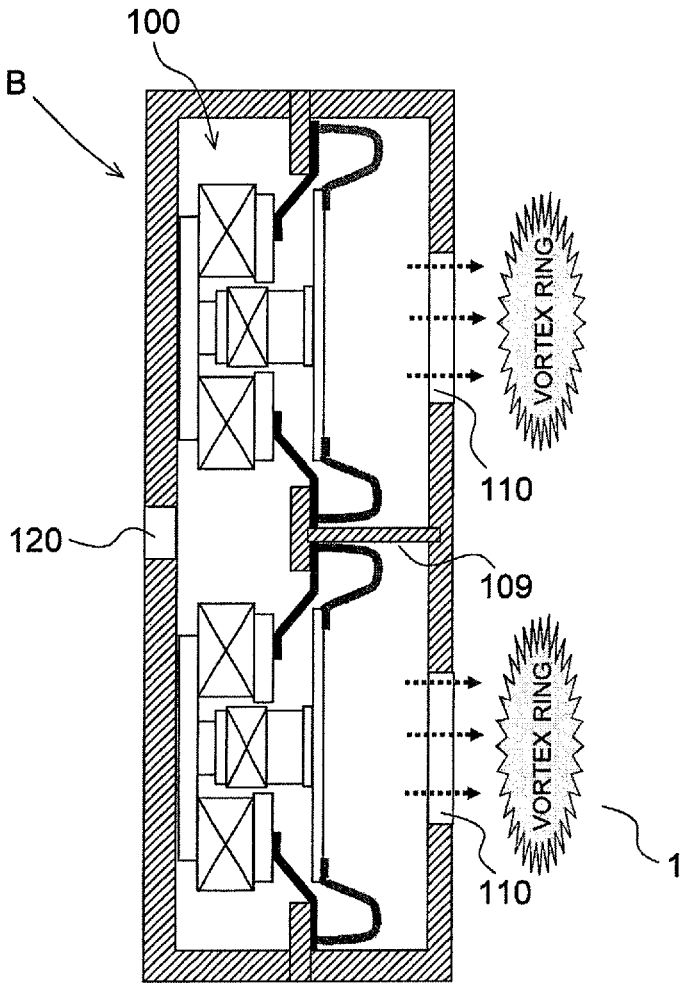
FIG. 6 is a schematic sectional structural diagram illustrating a schematic configuration of a fluid sending apparatus according to Embodiment 2 of the invention.

FIG. 6 is a schematic sectional structural diagram illustrating a schematic configuration of a fluid sending apparatus B according to Embodiment 2 of the invention. The fluid sending apparatus B will be described in detail with reference to FIG. 6. Although the fluid sending apparatus B has the same fundamental configuration as the fluid sending apparatus A described in Embodiment 1, the fluid sending apparatus B differs from the fluid sending apparatus A in that the fluid sending apparatus B includes multiple driving mechanisms 100. In Embodiment 2, the difference from Embodiment 1 will be mainly described. The same elements as those in Embodiment 1 are designated by the same reference numerals and the description thereof is omitted.

The fluid sending apparatus B is configured to enable lumps of fluid to be sent in one or two or more directions at the same time or with a time lag. As illustrated in FIG. 6, the fluid sending apparatus B is configured such that two driving mechanisms 100 are arranged in a cabinet 30. The two driving mechanisms 100 are arranged such that a partition 109 is disposed between the adjacent driving mechanisms 100 (specifically, between adjacent circular edges 22). An opening 120 is shared by the two driving mechanisms 100. A signal generator 170 (not illustrated) is connected to each of the driving mechanisms 100.

In this configuration, drive signals, as illustrated in FIG. 2 in Embodiment 1, are supplied to the two driving mechanisms 100 at the same time or with a time lag therebetween, so that two vortex rings can be discharged out of the cabinet 30. For example, the drive signals are timer-controlled to provide a time lag therebetween, so that the vortex rings can be emitted from the cabinet 30 with a time lag. Furthermore, outlets 110 are allowed to open in different directions, so that lumps of fluid can be sent in two or more directions. Although FIG. 6 illustrates the arrangement of the two driving mechanisms 100, any number of driving mechanisms 100 may be arranged.

Embodiment 3

Figure 7:
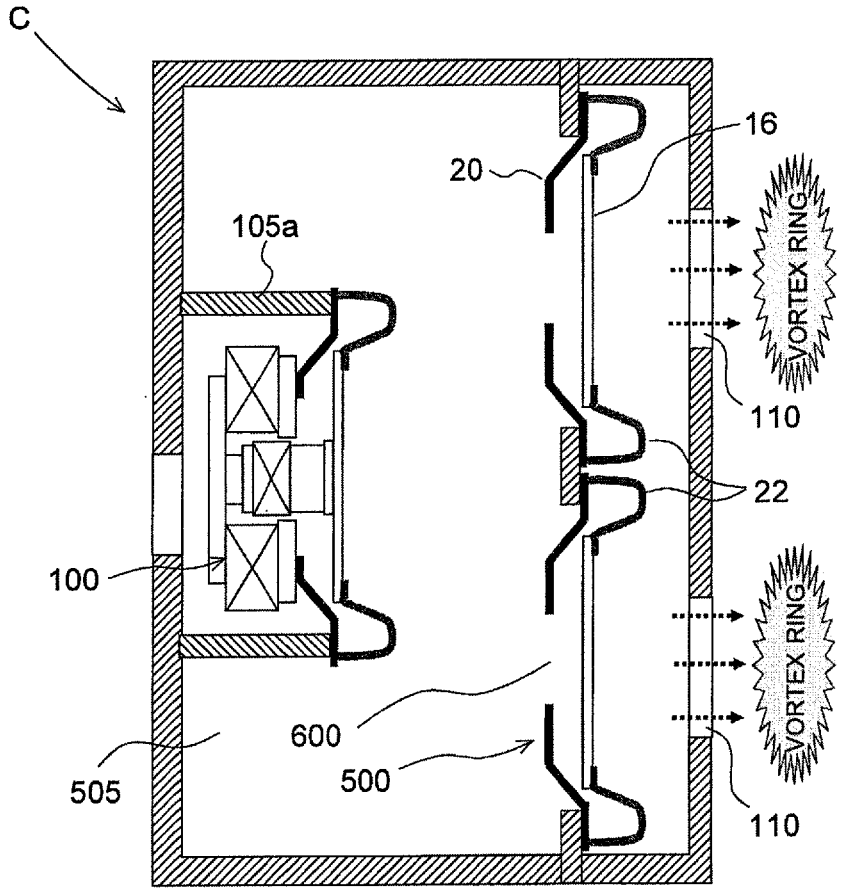
FIG. 7 is a schematic sectional structural diagram illustrating a schematic configuration of a fluid sending apparatus according to Embodiment 3 of the invention.
Figure 8:
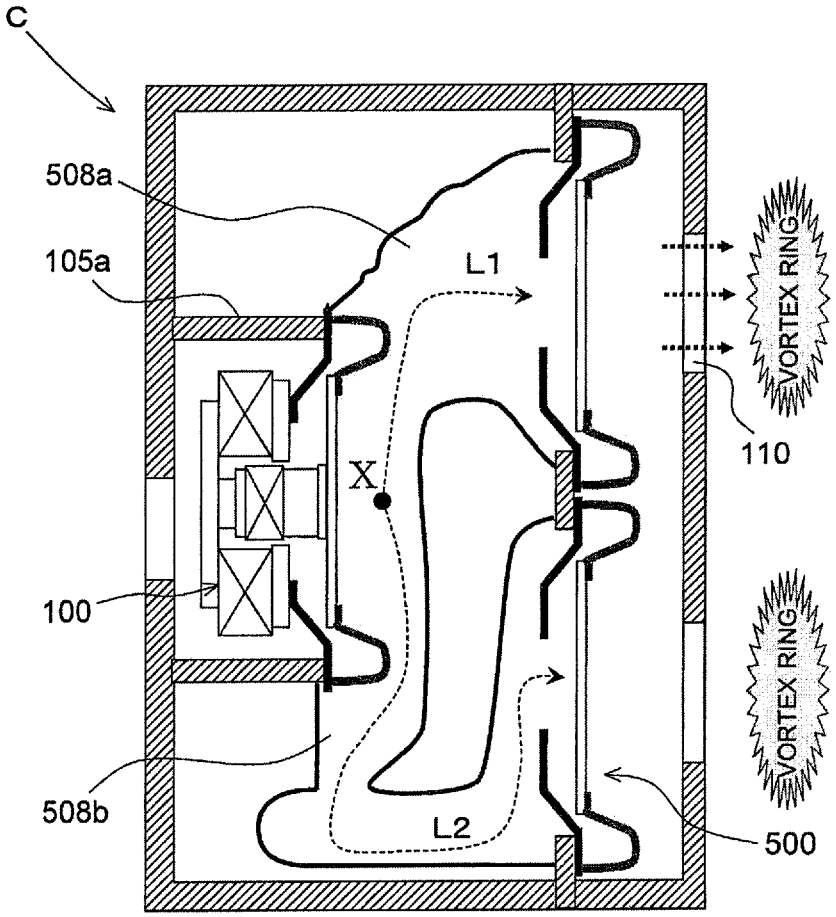
FIG. 8 is a schematic sectional structural diagram illustrating another schematic configuration of the fluid sending apparatus according to Embodiment 3 of the invention.

FIG. 7 is a schematic sectional structural diagram illustrating a schematic configuration of a fluid sending apparatus C according to Embodiment 3 of the invention. FIG. 8 is a schematic sectional structural diagram illustrating another schematic configuration of the fluid sending apparatus C according to Embodiment 3 of the invention. The fluid sending apparatus C will be described in detail with reference to FIGS. 7 and 8. Although the fluid sending apparatus C has the same fundamental configuration as the fluid sending apparatus A described in Embodiment 1, the fluid sending apparatus C differs from the fluid sending apparatus A in that the fluid sending apparatus C includes a single driving mechanism 100 and multiple vibrating units (hereinafter, referred to as "vibrating units 500"). In Embodiment 3, the difference from Embodiment 1 will be mainly described. The same elements as those in Embodiment 1 are designated by the same reference numerals and the description thereof is omitted.

Like the fluid sending apparatus B according to Embodiment 2, the fluid sending apparatus C is configured to enable lumps of fluid to be sent in one or two or more directions at the same time or with a time lag. As illustrated in FIG. 7, the fluid sending apparatus C is configured such that the single driving mechanism 100 and two vibrating units 500 facing a fluid sending direction (forward) are arranged in a cabinet 30. The driving mechanism 100 is disposed at a predetermined distance from the vibrating units 500. A frame 20 of the driving mechanism is supported not by a fixing member 105 but by a support member 105*a*. Ends of frames 20 of the two vibrating units 500 are supported by the fixing member 105.

A space in the cabinet 30, that is, a space that surrounds the driving mechanism 100 and is defined between the driving mechanism 100 and the vibrating units 500 will be referred to as a "space 505". A second fixing portion 20*b* of each vibrating unit 500 is not fixed to a plate 13. A central opening of each frame 20 will be referred to as an "opening 600". Specifically, a rear surface (facing the driving mechanism 100) of a diaphragm 16 of each vibrating unit 500 communicates with the space 505 through the opening 600.

In FIG. 7, each vibrating unit 500 includes the diaphragm 16, a circular edge 22, and the frame 20. Specifically, the vibrating unit 500 includes the elements, excluding the circular damper, constituting the vibrating unit provided for the driving mechanism 100 described in Embodiment 1 and Embodiment 2. This configuration allows the cost and weight to be lower than those of the fluid sending apparatuses according to Embodiments 1 and 2.

A drive signal as illustrated in FIG. 2 in Embodiment 1 is supplied to the fluid sending apparatus C, thus driving the fluid sending apparatus C. Consequently, pressure in the space 505 passes through the opening 600 of the frame in response to vibrations of the diaphragm 16 in the driving mechanism 100 and is transmitted to the diaphragms 16, serving as the elements of the vibrating units 500. Specifically, the vibrations of the diaphragm 16 of the driving mechanism 100 act as pressure waves for driving the diaphragms 16 of the vibrating units 500. Thus, pressure generated in the single driving mechanism 100 can be propagated to the multiple vibrating units 500 arranged in the cabinet 30. Obviously, a vortex ring can be sent if the fluid sending apparatus C includes a single vibrating unit 500.

Discharge of vortex rings using the two vibrating units 500 with a time lag therebetween in the fluid sending apparatus C will be described below. In the configuration illustrated in FIG. 7, vibrations generated in the driving mechanism 100 allow all of the vibrating units 500 to be driven at the same time. On the other hand, if the diaphragms 16 of the vibrating units 500 are made to differ in weight from each other, the motions of the diaphragms 16 of the multiple vibrating units 500 can be changed. An increase and a decrease in weight may be determined by changing, for example, materials and thicknesses of the diaphragms 16 of the vibrating units 500.

Furthermore, as illustrated in FIG. 8, multiple acoustic paths (a first acoustic path 508*a* and a second acoustic path 508*b*) having different lengths may be arranged in the cabinet 30 to change the motions of the diaphragms 16 of the multiple vibrating units 500. Each acoustic path is a route that is defined by partition members (made of, for example, metal or resin) arranged in the space 505 of the cabinet 30 and extends from the driving mechanism 100 to the corresponding vibrating unit 500. As illustrated in FIG. 8, the acoustic path having a length L1 is the first acoustic path 508*a* and the other acoustic path having a length L2 is the second acoustic path 508*b*.

The length L1 corresponds to a distance from a start central point (point X in FIG. 8) of pressure fluctuations generated in the driving mechanism 100 to the diaphragm 16 of the upper vibrating unit 500 in the drawing sheet of FIG. 8. The length L2 corresponds to a distance from the start central point X of pressure fluctuations generated in the driving mechanism 100 to the diaphragm 16 of the lower vibrating unit 500 in the drawing sheet of FIG. 8. FIG. 8 illustrates a state where L1<L2. This allows pressure fluctuations to reach the diaphragms 16 of the vibrating units 500 with a time lag. The vibrating units 500 can be driven independently. Consequently, lumps of fluid can be sent with a time lag therebetween.

In this configuration, a drive signal, as illustrated in FIG. 2 in Embodiment 1, is supplied to the single driving mechanism 100 to transmit vibrations to the two vibrating units 500 at the same time or with a time lag therebetween, so that vortex rings can be discharged out of the cabinet 30. Additionally, the outlets 110 may be allowed to open in different directions, so that lumps of fluid can be sent in two or more directions. Although FIGS. 7 and 8 illustrate the arrangement of the two vibrating units 500, any number of vibrating units 500 may be arranged.

Although Embodiments 1 to 3 of the invention have been described above, the invention may include combinations of features of Embodiments 1 to 3.

REFERENCE SIGNS LIST

1, fluid sending space; 10, yoke; 11, center pole; 12, magnet; 13, plate; 14, voice coil; 15, voice coil bobbin; 16, diaphragm; 17, adhesive layer; 20, frame; 20*a*, first fixing portion; 20*b*, second fixing portion; 20*c*, tapered portion; 21, circular damper; 22, circular edge; 30, cabinet; 100, driving mechanism; 103, magnetic circuit; 105, fixing member; 105*a*, support member; 106, pressurized space; 107, rear space; 109, partition; 110, outlet; 120, opening; 150, drive signal processing unit; 160, amplifying unit; 170, signal generator; 200, schematic signal waveform; 201, rising component; 202, falling component; 203, vortex ring formation time component; 204, damping component; 210, maximum value; 500, vibrating unit; 505, space; 508*a*, first acoustic path; 508*b*, second acoustic path; 600, opening; A, fluid sending apparatus; B, fluid sending apparatus; and C, fluid sending apparatus.

The invention claimed is:

1. A fluid sending apparatus comprising:

at least one driving mechanism that includes a diaphragm to apply sending force to fluid, the driving mechanism vibrating the diaphragm; and a signal generator including:

a drive signal processor configured to generate a signal to vibrate the diaphragm, and an amplifier amplifying the signal generated by the drive signal processor and transmitting an amplified signal to the driving mechanism, wherein the drive signal processor and the amplifier are configured to:

supply the amplified signal driving the diaphragm that applies the sending force to the fluid, the amplified driving signal being an uninterrupted single wave consisting of a single positive voltage component and a single negative voltage damping component, the single positive voltage component and the single negative voltage damping component each having a one-sided waveform and together forming the uninterrupted single wave, move the diaphragm from a resting position by driving the diaphragm in accordance with the one-sided waveform of the single positive voltage component of the amplified drive signal driving the diaphragm, and return the diaphragm to the resting position by driving the diaphragm in accordance with the one-sided waveform of the single negative voltage damping component of the amplified drive signal driving the diaphragm, wherein the single positive voltage component consists of a rising component of continuously increasing voltage in a positive voltage direction which increases up to a maximum voltage value, and a falling component extending from the maximum voltage value and having a continuously decreasing positive voltage and terminating with an initiation of a falling component of the single negative voltage damping component, a formation time of the single positive voltage component extending from an initiation of the rising component of the single positive voltage component until a termination of the falling component of the single positive voltage component, and wherein the single negative voltage damping component consists of the falling component which has a continuously decreasing negative voltage from an initiation of the falling component to a most negative voltage and a rising component having a continuously increasing voltage in a positive voltage direction from the most negative voltage value, a formation time of the single negative voltage damping component being smaller than the formation time of the single positive voltage component, the single negative voltage damping component having a voltage that is less than or equal to one-half of a voltage of the positive voltage component.

2. The fluid sending apparatus of claim 1, wherein the driving mechanism includes:

a voice coil bobbin which is connected to the diaphragm and around which a voice coil acting as an electromagnet is wound, a first elastic member connected to a periphery of the diaphragm and holding the diaphragm, the first elastic member being toroidal, and a second elastic member connected to an outer circumferential surface of the voice coil bobbin and holding the voice coil bobbin, the second elastic member being toroidal.

3. The fluid sending apparatus of claim 2, wherein the voice coil bobbin is connected to the diaphragm via a viscous adhesive layer.

4. The fluid sending apparatus of claim 1, wherein the driving mechanism is driven at a frequency less than or equal to a resonant frequency F0 of the driving mechanism and for a period of time calculated as a reciprocal of the frequency, and the resonant frequency F0 of the driving mechanism is defined as a frequency at which the whole driving mechanism lies in a resonant state where the driving mechanism is disposed in a cabinet configured to hold the driving mechanism.

5. The fluid sending apparatus of claim 4, wherein sharpness Q of resonance at the resonant frequency F0 is greater than or equal to 1.

6. The fluid sending apparatus of claim 1, wherein the fluid comprises a gas-phase, a steam, or an oily material.

7. The fluid sending apparatus of claim 6, wherein the oily material is an aromatic oil.

8. The fluid sending apparatus of claim 1, wherein the driving of the diaphragm in accordance with the one-sided waveform of the single positive voltage component contributes to a shape of the fluid being sent.

* * * * *